US006547655B1

(12) United States Patent
Schaffner

(10) Patent No.: US 6,547,655 B1
(45) Date of Patent: Apr. 15, 2003

(54) FLAME-RESISTANT BUFFING WHEEL AND METHOD

(75) Inventor: J. Allen Schaffner, Pittsburgh, PA (US)

(73) Assignee: Schaffner Manufacturing Company, Inc., Pittsburgh, PA (US)

( * ) Notice: Subject to any disclaimer, the term of this patent is extended or adjusted under 35 U.S.C. 154(b) by 0 days.

(21) Appl. No.: 09/896,639

(22) Filed: Jun. 29, 2001

(51) Int. Cl.[7] ..... B24B 9/02
(52) U.S. Cl. ..... 451/466; 451/526
(58) Field of Search ..... 451/526, 466, 451/490, 527, 530, 538, 539

(56) References Cited

U.S. PATENT DOCUMENTS 3,629,052 A * 12/1971 Knoepfler et al. ..... 28/166
3,645,814 A * 2/1972 Knoepfler et al. ..... 156/62.8
3,769,058 A * 10/1973 Bayer et al. ..... 118/206
3,865,678 A * 2/1975 Okamoto et al. ..... 139/35
3,991,526 A * 11/1976 Frank et al. ..... 15/230.15
4,062,818 A * 12/1977 Mate ..... 128/849
4,154,878 A * 5/1979 Baitinger et al. ..... 427/341
5,807,161 A * 9/1998 Manor et al. ..... 451/442
5,830,325 A * 11/1998 Mahler et al. ..... 203/43
5,851,436 A * 12/1998 Merchant et al. ..... 252/364
5,910,615 A * 6/1999 Jackson et al. ..... 570/142
5,924,917 A * 7/1999 Benedict et al. ..... 451/526
6,066,769 A * 5/2000 Nappa et al. ..... 570/166
6,184,426 B1 * 2/2001 Belen'kii et al. ..... 570/172
6,255,544 B1 * 7/2001 Sievert ..... 570/181
6,387,993 B1 * 5/2002 Batdorf ..... 428/391
6,420,459 B1 * 7/2002 Horold ..... 523/451

FOREIGN PATENT DOCUMENTS

GB 2225969 A * 6/1990 ..... B24D/13/00

* cited by examiner

*Primary Examiner*—Joseph J. Hail, III
*Assistant Examiner*—David B. Thomas
(74) *Attorney, Agent, or Firm*—Reed Smith LLP

(57) ABSTRACT

A flame-resistant buffing wheel and a method of making thereof. The buffing wheel is comprised of a buffing material which has been treated with an aqueous flame-retardant solution, and allowed to dry. The treatment may take place either before or after the buffing wheel is assembled.

103 Claims, 2 Drawing Sheets

33
49
43
47
45

49
33
43
35

41
45
47

FLAME-RESISTANT BUFFING WHEEL AND METHOD

FIELD OF THE INVENTION

This invention relates to the buffing or finishing of objects of metal and other compositions and it has particular relationship to buffing materials and a method for making them flame-resistant.

BACKGROUND OF THE INVENTION

A buffing wheel or buff typically includes a ring of metal from which extends an annulus of buffing material. Cotton fabric, polyester/cotton fabric, and sisal are commonly used as buffing material. The ring has teeth which engage the annulus of buffing material near its inner periphery and hold the buffing material in place.

In use, the buffing wheel is mounted on a drive shaft and is rotated. The rotating buffing wheel and the object to be buffed are in contact during the buffing process. Although buffing wheels are used singularly, common practice is to stack or gang a number of buffing wheels on a shaft for the purpose of buffing large objects like steel bumpers, aluminum extrusions and the like. Examples of buffing apparatus are disclosed in U.S. Pat. Nos. 2,805,530; 3,365,742; 3,706,167; 3,967,418; 4,799,338; 4,850,158; 4,882,880 and 5,560,744, the disclosures of which are incorporated by reference herein.

The buffing material (fabric and the like) from which layers in buffing wheels have been composed commonly include cotton and/or sisal. Sisal is a long coarse fiber that is twisted into strands and woven into a buffing material. Different buffing materials are used for different applications. In addition, the stiffness of the cotton buffing material may be regulated by the application of stiffening agents such as resins and ethylene vinyl acetates or polyethylene vinyl acetates either before or after the assembly of the buffing wheel.

In a typical buffing operation, a buffing compound such as an emulsion of hydrogenated fatty acids, water and abrasive grains is applied to the periphery of the buffing wheel. The buffing wheels are rotated at a high speed, typically 5000–9500 surface feet per minute. The object to be buffed makes contact with the buffing wheel during the process.

As the buffing wheels are used, the buffing material produces a dust and/or lint-like residue or swarf. Additionally, the buffing process generates metallic residue from the object being buffed. The residue from the buffing material and the metallic residue from the buffed object combine with residual buffing compound to form a highly-flammable buffing residue. Buffing residue as defined in this application includes the dust and/or lint-like buffing residue from the buffing material alone or with any combination of the metallic residue and/or the residual buffing compound.

Potential fires associated with this buffing residue are a serious concern. In order to avoid these fires, the buffing residue typically is removed by a conventional-type air exhaust system and is then collected in a collector, such as a bag house. The contents of the bag house must be removed often or the highly volatile contents may catch fire in the bag house through spontaneous combustion.

A second potential source of fire is from the buffing wheels themselves. Due to heat created by the various sources of friction (e.g., between the clinch ring and the drive shaft, the buffing material and the work piece, etc.) the buffing material is also at risk of catching fire during the buffing process.

SUMMARY OF THE INVENTION

The present invention provides a flame-resistant buffing wheel and a method of making same The buffing wheels of the present invention are comprised of a buffing material which has been treated with an flame-retardant solution. The buffing material may be treated either before or after the buffing wheels are assembled.

The flame-retardant solution includes a flame-retardant compound, and a penetrating agent which is applied to the buffing material. The treated buffing material is then allowed to dry. During tests of the treated buffing material over an open flame, no flame appears on the buffing material but the buffing material may smolder. The buffing residues resulting from the use of treated buffing wheels have also been found to be flame-resistant.

Advantages of this invention over prior systems are that in addition to rendering the buffing material flame-resistant, the buffing residues are also rendered flame-resistant.

The buffing wheels made in accordance with the present invention may be of any design presently known or contemplated in the future. Examples of known forms of buffing apparatus are illustrated in the drawings.

BRIEF DESCRIPTION OF THE DRAWINGS

The features, aspects, and advantages of the present invention will become better understood with regard to the following description, appended claims, and accompanying drawings where:

DETAILED DESCRIPTION OF THE INVENTION

Figure 1:
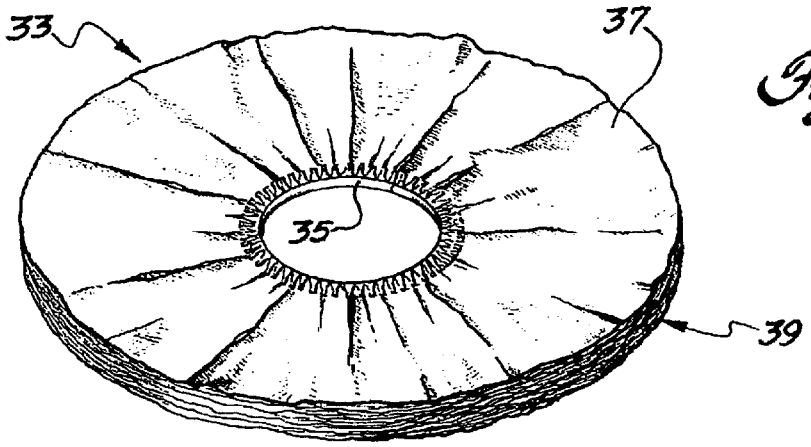
FIG. 1 is a perspective view of a buffing wheel.
Figure 2:
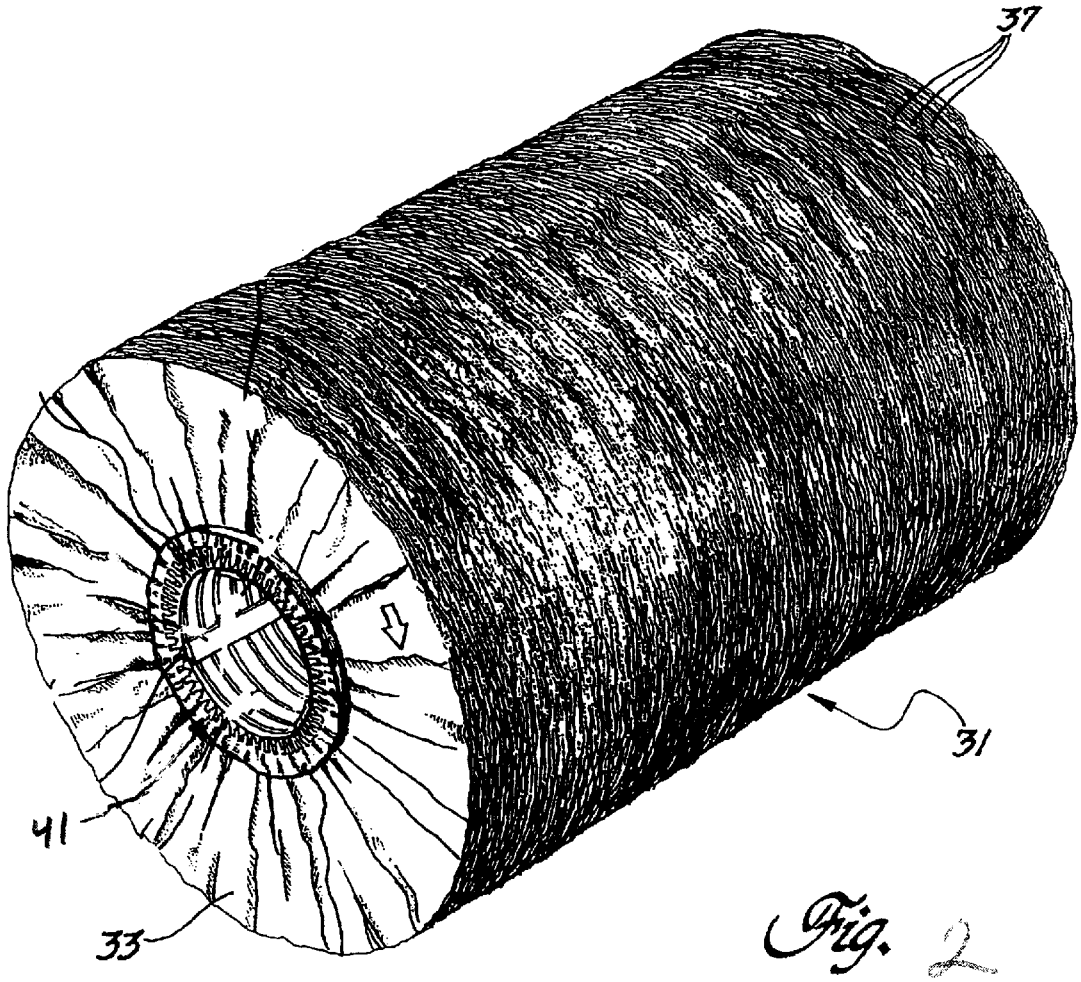
FIG. 2 is a perspective view of a ganged or stacked buffing apparatus.

The buffing wheel 33 shown in FIG. 1 includes a metallic clinch ring 35 typically made of steel, securing layers 37 of buffing material which extend radially from the ring in an annulus 39. A buffing apparatus 31 formed of ganged or stacked buffing wheels 33 is shown in FIG. 2. The buffing apparatus 31 may be formed of buffing wheels 33 alone, or it may be formed of buffing wheels 33 combined with spacers 49. Buffing wheels may also be used individually.

The buffing material typically contains one or more of the following: cotton, polyester/cotton blend, and sisal, although other materials may be used. Preferably, the buffing material consists substantially of cotton fabric. To make a buffing wheel, the buffing material is cut on a bias of approximately 30° to 60°. It is cut to desired widths (typically 4 to 18 inches, depending on desired dimension), and rolled into lengths of up to 1,000 yards. The rolled, biased, cut buffing material is then wound on a split drum of an iris machine drum. The iris closes, tucking the buffing material into a metal clinch ring which is mounted in between the split drum. The drum may be any diameter, typically 6 to 36 inches. The buff section is then removed from the iris machine.

The buffing material of the present invention is treated with a flame-retardant solution comprised of a flame-retardant compound, a penetrating agent and water. The flame-retardant compound is preferably an aqueous halogenated compound of the type manufactured by Apollo Chemical Corporation under the name of BARFIRE PCR. The penetrating agent is preferably a surfactant and most preferably Silwet L-77 surfactant having the chemical name Polyalkyleneoxide Modified Heptamethyltrisiloxane manufactured by CK Witco Corporation. An effective amount of the flame-retardant compound is used to minimize the flammability of the buffing residues and buffing material. The effective amount of flame-retardant compound present in the solution is at least about 15% and in the range of about 15–40% (preferably about 35%) by weight of solution. The effective amount of flame-retardant compound in the flame-retardant solution typically varies with the weave of the buffing material. More flame-retardant compound typically is needed when the weave of the buffing material is closed (or tighter). Open weave buffing material requires less flame-retardant compound.

The effective amount of penetrating agent is at least about 0.025% and in the range of 0.025–0.6% (preferably 0.04%) by weight of solution. The penetrating agent functions to help "wet" the buffing material, enhancing penetration into the buffing material by the solution. Like the amount of flame-retardant compound, the effective amount of penetrating agent typically varies with the weave of the buffing material. More penetrating agent is needed when the weave of the buffing material is closed. Open weave buffing material requires less penetrating agent. The solution also comprises water, and may also include known stiffening agents and/or dyes typically used for buffing materials.

Figures 3A, 3B, 3C:
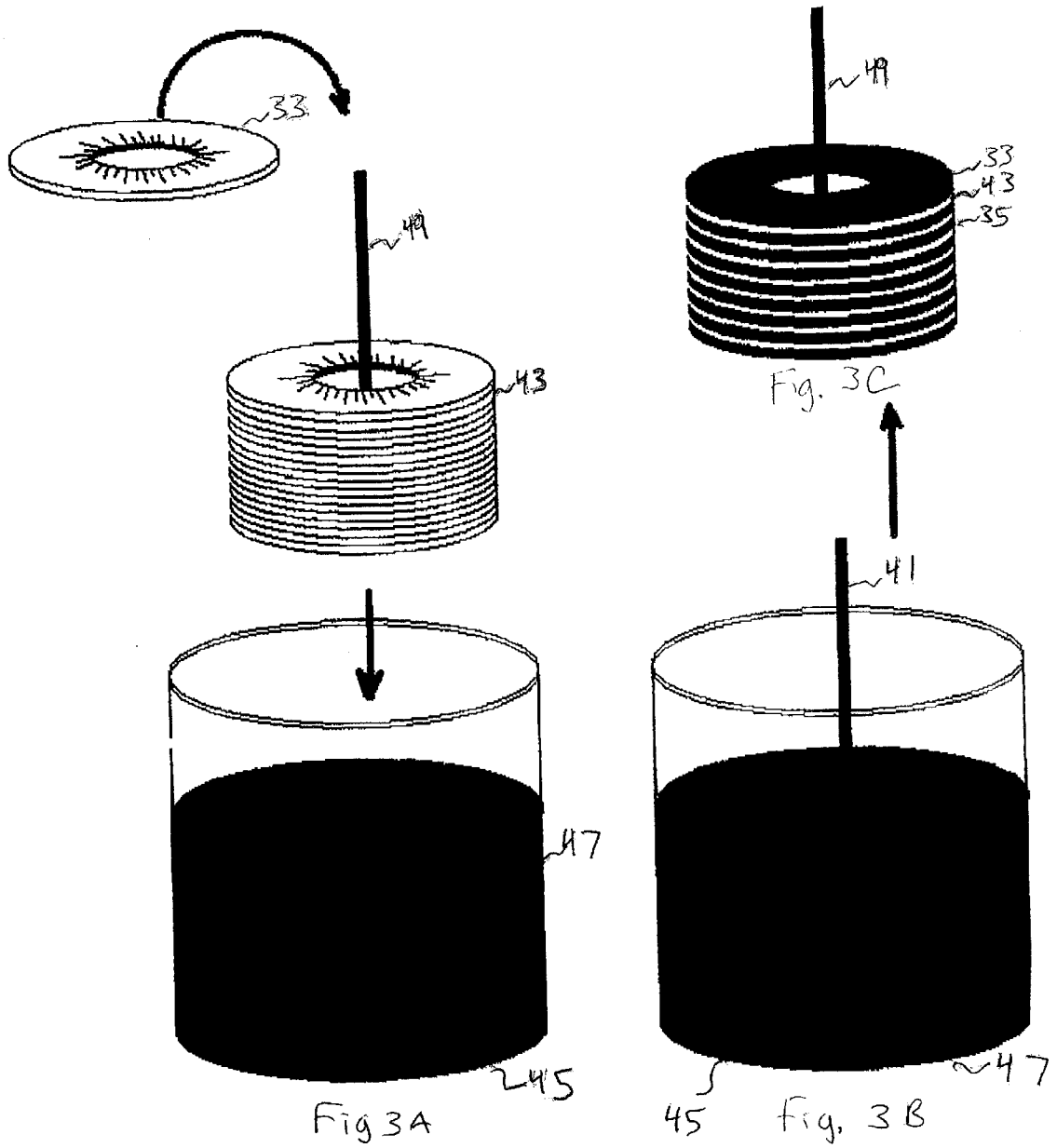
FIGS. 3A, 3B and 3C are perspective views of the system for treating the buffing material on an assembled buffing wheel.

In order to treat the buffing material of an assembled buffing wheel 33, the components of the flame-retardant solution are mixed in a larger container or drum 45. In one embodiment, the buffing wheels 33 are arranged horizontally on a vertical pole 49 separated by typically 0.75 to 1.25 inch spacers 43 (FIG. 3A). The pole 49 is lowered vertically into the container 45 so that the buffing wheels 33 are immersed in the solution 47 (FIG. 3B). After a period of time, preferably one to five minutes, depending on the buffing material, the pole 49 is removed from the solution (FIG. 3C) and the buffing wheels 33 are allowed to dry. During the drying process, the pole is allowed to drip for 7 to 11 minutes. Afterwards the buffing wheels are spun for 3 to 6 minutes at at least about 200 revolutions per minute on the pole. The buffing wheels 33 may be spun dry on the pole itself or may be preferably loaded onto a rotary shaft on which they are spun. Also, the buffing wheels may be dried in a heat room at 90 to 120° F., or an oven with a temperature range of 150 to 190° F.

In another embodiment, the buffing material may be treated by vertically dipping a portion of the buffing material into the fire-retardant solution and then rotating the buffing wheel so that substantially all of the buffing material is sufficiently treated. The buffing wheels are then dried as described.

Buffing material treated before buffing wheel assembly may be treated in this manner: the flame-retardant solution is applied to buffing material at the time of the standard process of cloth dying, starching or finishing. The solution may be preferably incorporated into existing treatments, or be applied separately. Typically, buffing material is run in a single ply through a "bath" of treatment, then through a drying process for heating and/or curing the buffing material, and finally rolled into high yardage rolls. Assembly of the buffing wheels then takes place in a conventional manner.

If not otherwise stated herein, it may be assumed that all components and/or processes described heretofore may, if appropriate, be considered to be interchangeable with similar components and/or processes, unless an indication is made to the contrary.

It should be appreciated that the apparatus and methods of the present invention may be configured and conducted as appropriate for the application. The embodiments described above are to be considered in all respects only as illustrative and not restrictive. The scope of the invention is defined by the following claims rather than by the foregoing description. All changes which come within the meaning and range of equivalency of the claims are to be embraced within their scope.

What is claimed is:

1. A method of making a flame-resistant buffing wheel comprising:

providing a buffing wheel comprising a buffing material portion and a clinch ring portion;

applying a flame-retardant solution to at least said buffing material portion; and drying said buffing material portion.

2. The method of claim 1 wherein the flame-retardant solution comprises at least a flame-retardant compound.

3. The method of claim 2 wherein the flame-retardant compound is present in the amount of at least about 15% by weight of the solution.

4. The method of claim 2 wherein the flame-retardant compound is present in the amount of at least about 20% by weight of the solution.

5. The method of claim 2 wherein the flame-retardant compound is present in the amount of at least about 25% by weight of the solution.

6. The method of claim 2 wherein the flame-retardant compound is present in the amount of at least about 30% by weight of the solution.

7. The method of claim 2 wherein the flame-retardant compound is present in the amount of at least about 35% by weight of the solution.

8. The method of claim 2 wherein the flame-retardant compound is present in the amount of at least about 40% by weight of the solution.

9. The method of claim 2 wherein the flame-retardant solution further comprises a penetrating agent.

10. The method of claim 9 wherein the penetrating agent is a surfactant.

11. The method of claim 10 wherein the surfactant is present in the amount of at least about 0.025% by weight of the solution.

12. The method of claim 10 wherein the surfactant is present in the amount of at least about 0.05% by weight of the solution.

13. The method of claim 10 wherein the surfactant is present in the amount of at least about 0.1% by weight of the solution.

14. The method of claim 10 wherein the surfactant is present in the amount of at least about 0.2% by weight of the solution.

15. The method of claim 10 wherein the surfactant is present in the amount of at least about 0.3% by weight of the solution.

16. The method of claim 10 wherein the surfactant is present in the amount of at least about 0.4% by weight of the solution.

17. The method of claim 10 wherein the surfactant is present in the amount of at least about 0.5% by weight of the solution.

18. The method of claim 10 wherein the surfactant is present in the amount of at least about 0.6% by weight of the solution.

19. The method of claim 2 wherein the flame-retardant solution further comprises a stiffening agent.

20. The method of claim 2 wherein the flame-retardant solution further comprises a dye.

21. The method of claim 1 wherein the step of applying the flame-retardant solution comprises dipping said buffing wheel in a container of said flame-retardant solution.

22. The method of claim 21 wherein the step of applying the flame-retardant solution further comprises arranging said buffing wheel on a pole before dipping said buffing wheel in said flame-retardant solution.

23. A flame-resistant buffing wheel made using the method of claim 1.

24. A method of increasing the flame-resistance of buffing residue comprising using a buffing wheel with a buffing material portion that has been treated with a flame-retardant solution.

25. The method of claim 24 wherein the flame-retardant solution comprises at least a flame-retardant compound.

26. The method of claim 25 wherein the flame-retardant compound is present in the amount of at least about 15% by weight of the solution.

27. The method of claim 25 wherein the flame-retardant compound is present in the amount of at least about 20% by weight of the solution.

28. The method of claim 25 wherein the flame-retardant compound is present in the amount of at least about 25% by weight of the solution.

29. The method of claim 25 wherein the flame-retardant compound is present in the amount of at least about 30% by weight of the solution.

30. The method of claim 25 wherein the flame-retardant compound is present in the amount of at least about 35% by weight of the solution.

31. The method of claim 25 wherein the flame-retardant compound is present in the amount of at least about 40% by weight of the solution.

32. The method of claim 24 wherein the flame-retardant solution further comprises a penetrating agent.

33. The method of claim 32 wherein the penetrating agent is a surfactant.

34. The method of claim 33 wherein the surfactant is present in the amount of at least about 0.025% by weight of the solution.

35. The method of claim 33 wherein the surfactant is present in the amount of at least about 0.5% by weight of the solution.

36. The method of claim 33 wherein the surfactant is present in the amount of at least about 0.1% by weight of the solution.

37. The method of claim 33 wherein the surfactant is present in the amount of at least about 0.2% by weight of the solution.

38. The method of claim 33 wherein the surfactant is present in the amount of at least about 0.3% by weight of the solution.

39. The method of claim 33 wherein the surfactant is present in the amount of at least about 0.4% by weight of the solution.

40. The method of claim 33 wherein the surfactant is present in the amount of at least about 0.5% by weight of the solution.

41. The method of claim 33 wherein the surfactant is present in the amount of at least about 0.6% by weight of the solution.

42. The method of claim 25 wherein the flame-retardant solution further comprises water.

43. The method of claim 25 wherein the flame-retardant solution further comprises a stiffening agent.

44. The method of claim 25 wherein the flame-retardant solution further comprises a dye.

45. A method of reducing the risk of buffing residue collector fires comprising:

using a buffing wheel with a buffing material portion that had been treated with a flame-retardant solution.

46. The method of claim 45 wherein the flame-retardant solution comprises a flame-retardant compound.

47. The method of claim 46 wherein the flame-retardant compound is present in the amount of at least about 15% by weight of the solution.

48. The method of claim 46 wherein the flame-retardant compound is present in the amount of at least about 20% by weight of the solution.

49. The method of claim 46 wherein the flame-retardant compound is present in the amount of at least about 25% by weight of the solution.

50. The method of claim 46 wherein the flame-retardant compound is present in the amount of at least about 30% by weight of the solution.

51. The method of claim 46 wherein the flame-retardant compound is present in the amount of at least about 35% by weight of the solution.

52. The method of claim 46 wherein the flame-retardant compound is present in the amount of at least about 40% by weight of the solution.

53. The method of claim 46 wherein the flame-retardant solution further comprises a penetrating agent.

54. The method of claim 53 wherein the penetrating agent is a surfactant.

55. The method of claim 54 wherein the surfactant is present in the amount of at least about 0.025% by weight of the solution.

56. The method of claim 54 wherein the surfactant is present in the amount of at least about 0.5% by weight of the solution.

57. The method of claim 54 wherein the surfactant is present in the amount of at least about 0.1% by weight of the solution.

58. The method of claim 54 wherein the surfactant is present in the amount of at least about 0.2% by weight of the solution.

59. The method of claim 54 wherein the surfactant is present in the amount of at least about 0.3% by weight of the solution.

60. The method of claim 54 wherein the surfactant is present in the amount of at least about 0.4% by weight of the solution.

61. The method of claim 54 wherein the surfactant is present in the amount of at least about 0.5% by weight of the solution.

62. The method of claim 54 wherein the surfactant is present in the amount of at least about 0.6% by weight of the solution.

63. The method of claim 46 wherein the flame-retardant solution further comprises water.

64. The method of claim 46 wherein the flame-retardant solution further comprises a stiffening agent.

65. The method of claim 46 wherein the flame-retardant solution further comprises a dye.

66. A method of making a flame-resistant buffing wheel comprising:

applying a flame-retardant solution to buffing material; and assembling a buffing wheel using said buffing material.

67. The method of claim 66 wherein the flame-retardant solution comprises a flame-retardant compound.

68. The method of claim 67 wherein the flame-retardant compound is present in the amount of at least about 15% by weight of the solution.

69. The method of claim 67 wherein the flame-retardant compound is present in the amount of at least about 20% by weight of the solution.

70. The method of claim 67 wherein the flame-retardant compound is present in the amount of at least about 25% by weight of the solution.

71. The method of claim 67 wherein the flame-retardant compound is present in the amount of at least about 30% by weight of the solution.

72. The method of claim 67 wherein the flame-retardant compound is present in the amount of at least about 35% by weight of the solution.

73. The method of claim 67 wherein the flame-retardant compound is present in the amount of at least about 40% by weight of the solution.

74. The method of claim 67 wherein the flame-retardant solution further comprises a penetrating agent.

75. The method of claim 74 wherein the penetrating agent is a surfactant.

76. The method of claim 75 wherein the surfactant is present in the amount of at least about 0.025% by weight of the solution.

77. The method of claim 75 wherein the surfactant is present in the amount of at least about 0.05% by weight of the solution.

78. The method of claim 75 wherein the surfactant is present in the amount of at least about 0.1% by weight of the solution.

79. The method of claim 75 wherein the surfactant is present in the amount of at least about 0.2% by weight of the solution.

80. The method of claim 75 wherein the surfactant is present in the amount of at least about 0.3% by weight of the solution.

81. The method of claim 75 wherein the surfactant is present in the amount of at least about 0.4% by weight of the solution.

82. The method of claim 75 wherein the surfactant is present in the amount of at least about 0.5% by weight of the solution.

83. The method of claim 75 wherein the surfactant is present in the amount of at least about 0.6% by weight of the solution.

84. The method of claim 67 wherein the flame-retardant solution further comprises a stiffening agent.

85. The method of claim 67 wherein the flame-retardant solution further comprises a dye.

86. A flame-resistant buffing wheel comprising a buffing material which has been treated with a flame retardant solution including an effective amount of a flame-retardant compound.

87. The buffing wheel of claim 86 wherein the flame-retardant compound is present in the amount of at least about 15% by weight of the solution.

88. The buffing wheel of claim 86 wherein the flame-retardant compound is present in the amount of at least about 20% by weight of the solution.

89. The buffing wheel of claim 86 wherein the flame-retardant compound is present in the amount of at least about 25% by weight of the solution.

90. The buffing wheel of claim 86 wherein the flame-retardant compound is present in the amount of at least about 30% by weight of the solution.

91. The buffing wheel of claim 86 wherein the flame-retardant compound is present in the amount of at least about 35% by weight of the solution.

92. The buffing wheel of claim 86 wherein the flame-retardant compound is present in the amount of at least about 40% by weight of the solution.

93. The buffing wheel of claim 86 wherein the flame-retardant solution further comprises a penetrating agent.

94. The buffing wheel of claim 93 wherein the penetrating agent is a surfactant.

95. The buffing wheel of claim 94 wherein the surfactant is present in the amount of at least about 0.025% by weight of the solution.

96. The buffing wheel of claim 94 wherein the surfactant is present in the amount of at least about 0.05% by weight of the solution.

97. The buffing wheel of claim 94 wherein the surfactant is present in the amount of at least about 0.1% by weight of the solution.

98. The buffing wheel of claim 94 wherein the surfactant is present in the amount of at least about 0.2% by weight of the solution.

99. The buffing wheel of claim 94 wherein the surfactant is present in the amount of at least about 0.3% by weight of the solution.

100. The buffing wheel of claim 94 wherein the surfactant is present in the amount of at least about 0.4% by weight of the solution.

101. The buffing wheel of claim 94 wherein the surfactant is present in the amount of at least about 0.5% by weight of the solution.

102. The buffing wheel of claim 94 wherein the surfactant is present in the amount of at least about 0.6% by weight of the solution.

103. The buffing wheel of claim 86 wherein the buffing material is fabric made substantially of cotton.

* * * * *